United States Patent [19]

Ponza

[11] Patent Number: 4,823,763

[45] Date of Patent: Apr. 25, 1989

[54] BALL PROJECTING APPARATUS

[76] Inventor: Larry J. Ponza, 910 Columbia St., Santa Cruz, Calif. 95060

[21] Appl. No.: 72,999

[22] Filed: Jul. 13, 1987

[51] Int. Cl.[4] ..... F41B 3/04

[52] U.S. Cl. ..... 124/78; 124/1; 124/6; 124/81

[58] Field of Search ..... 124/1, 4, 6, 78, 49, 124/51–53, 81

[56] References Cited

U.S. PATENT DOCUMENTS 3,399,660 9/1968 Swartout ..... 124/6

3,766,901 10/1973 Cleary et al. ..... 124/78

3,774,584 11/1973 Paulson ..... 124/78

4,195,614 4/1980 Ponza ..... 124/1

*Primary Examiner*—Randolph A. Reese

*Assistant Examiner*—John A. Ricci

*Attorney, Agent, or Firm*—Flehr, Hohbach, Test, Albritton & Herbert

[57] ABSTRACT

A ball throwing machine which includes a pair of rotary discs supported for rotation and angularly opposed relation so as to laterally engage a ball and effect propulsion thereof is disclosed. A pair of positioning disc disposed on the interior ball-contacting surfaces of the flat-faced rotary disc precisely locate the balls to be projected on the rotary discs to insure consistency between throws or pitches.

17 Claims, 3 Drawing Sheets

BALL PROJECTING APPARATUS

BACKGROUND OF THE INVENTION

The present invention relates generally to a machine for throwing, pitching or otherwise propelling spherical objects such as baseballs, softballs, tennis balls or the like. More particularly, the present invention relates to a ball feeding and locating system that ensures that all of the balls thrown will be released consistently. The present invention is an improvement of the invention disclosed in U.S. Pat. No. 4,195,614, which is incorporated herein by reference.

A wide variety of ball throwing machines have been used in the past for activities such as batting and tennis practice. The early ball throwing machines typically employed swing arms, spring loaded mechanisms or simple mechanical impact plates to propel the balls. However, such devices experience considerable difficulty controlling the ball to obtain uniform throws. Additionally, such prior art machines can only throw "straight" balls and were incapable of throwing a ball with either a side spin or top spin. Thus, in the field of baseball, such a machine has the drawback of not being able to throw curves or sliders. Similarly in sports such as tennis, they are incapable of delivering balls with any significant top spin.

More recently ball throwing devices employing two counter-rotating wheels to propel the ball have become known in the art. For example, U.S. Pat. No. 4,195,614 discloses a ball throwing machine having a pair of rotating discs supported for rotation in angularly opposed relation so as to laterally engage a ball for propulsion. The machine disclosed in the '614 patent also contemplates rotating the discs at different speeds, thereby placing a sidespin on the ball. Thus, the ball throwing machine is able to throw "curves" or "sliders". The rotating wheels include concentric depressed angular grooves which serve to locate the radial position of the ball on the wheels themselves, thereby ensuring that the ball is consistently released from the same point. It is, of course, essential that the ball be released at the same point in order to ensure accurate control of its trajectory. While the '614 device is extremely effective, its one drawback is that the angular grooves cause the rotating discs to be relatively expensive to manufacture. Therefore, there is a need for a mechanism that is inexpensive to manufacture, yet capable of accurately positioning a ball within the environment of a pair of rotating discs to ensure that the ball is released at a consistent position.

Accordingly, it is a general objective of the present invention to provide a ball throwing machine that is capable of simulating most of the ball trajectories experienced in the actual playing of baseball, softball, tennis and other activities wherein the controlled propulsion of a ball or other similar spherical object is encountered. To achieve the foregoing and other objects and in accordance with the purpose of the present invention, a ball projective apparatus is provided that includes a pair of rotary ball-contacting discs having angularly opposed, substantially planar ball engaging surfaces whose spacing varies between a maximum distance greater than the diameter of the ball and a minimum distance no greater than the ball's diameter. A rotary means is provided to rotate the ball contacting members, and a pair of positioning discs precisely control the tangential release position for throwing the ball. The positioning discs are positioned co-axially with the ball contacting discs on their contact surfaces.

In accordance with an additional aspect of the invention, the rotary speed of the two ball contacting members can be different so as to impart a lateral spin to the propelled ball.

Preferably, the ball projecting apparatus also includes a feed chute having a biasing means such as a leaf spring for urging the balls to contact the positioning disks at a radial position that is before the position at which the natural geometry of the opposed ball contacting discs would force such contact.

BRIEF DESCRIPTION OF THE DRAWINGS

The features of the present invention which are believed to be novel are set forth with particularity in the appended claims. The invention, together with further objects and advantages thereof, may be understood by reference to the following description when taken in conjunction with the accompanying drawings in which:

DETAILED DESCRIPTION OF THE DRAWINGS

As is well known to sport enthusiasts, a baseball that is pitched as a straight fastball has some backspin. Similarly, a curve has a lateral spin, and primarily in the field of tennis ball, many balls are hit with a considerable degree of top spin. As a consequence, it is desirable to provide a device capable of imparting all such spins to a projected ball.

With such general considerations in mind, a relatively simple and inexpensive implementation of the invention can take the form of a pair of ball contacting discs mounted for rotation on generally aligned but slightly tilted axes so that a spacing between the ball engaging surfaces of the discs varies between a distance slightly greater than the diameter of the ball being propelled and a disc that is no greater than the ball diameter. The ball itself is introduced at a rotative position where the discs are separated by a distance that is greater than the balls diameter. The ball is then engaged and carried by the ball-contacting discs in a generally arcuate path until the spacing again increases to a point where the ball will be released and thrown. If these ball-contacting members are supported for rotation about substantially horizontal axes, the ball will be propelled therefrom in substantially a vertical plane in a direction determined by the precise rectangular disposition of the opposed ball-contacting members which accordingly can be adjusted so as to throw the ball in a more upwardly trajectory for fly-ball practice or downwardly direction to provide for ground-ball practice.

In order to impart a backspin to the ball thrown, it is necessary to engage each side of the ball at radially spaced-apart positions on the ball-contacting discs. This ensures that the outward radial contact will have a greater actual velocity than the inner contacts. Thus, when the ball is released, it will have either a topspin or a backspin. It will be appreciated that so long as the ball is released below the rotary axis of the discs, it will carry a backspin, thus simulating a straight, fast ball. Alternatively, if the ball is released above the rotary axis of the ball-contacting discs, a top spin will be imparted as, for example, in the propulsion of tennis balls to simulate the common topspin thereof as is frequently encountered in an actual game.

To provide lateral spin, separate variable speed motors can be connected to drive the two ball contacting discs. By adjusting the differential speed of such motors, the rotative velocity of the two ball-contacting discs will be varied thereby imparting a lateral spin to the propelled ball. In this manner, both curves and sliders may be thrown.

Figure 1:
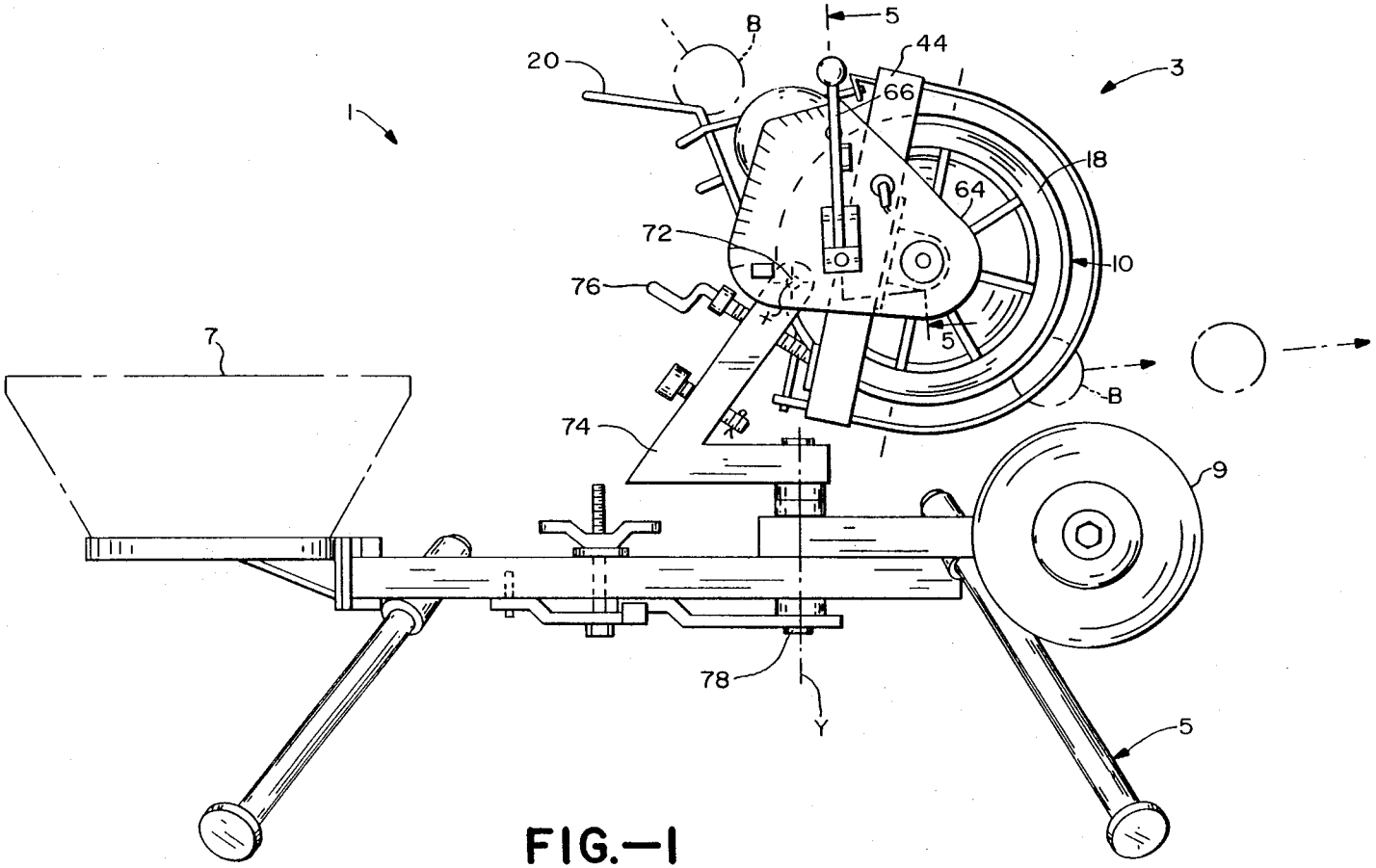
FIG. 1 is a side elevational view of a ball throwing machine embodying the present invention.
Figure 3:
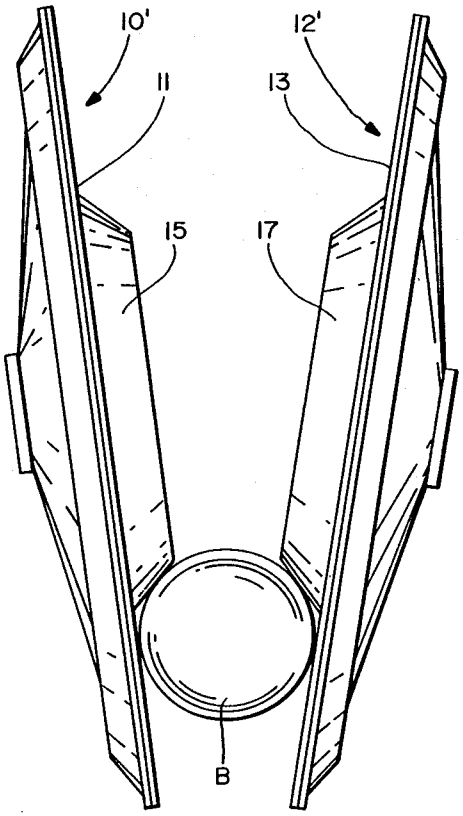
FIG. 3 is an enlarged cross-sectional view of the ball contacting discs shown in FIG. 1 featuring the positioning discs that precisely control the location of the ball relative to the ball contacting discs.
Figure 2:
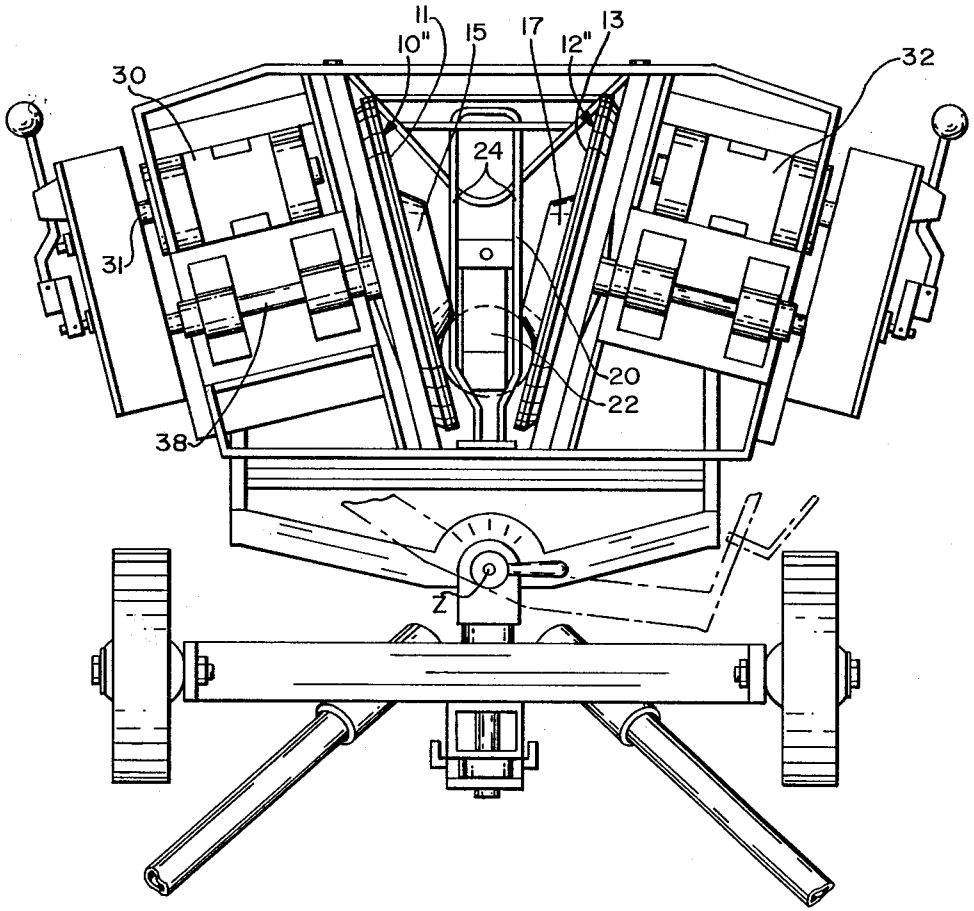
FIG. 2 is a front elevational view of the embodiment shown in FIG. 1 with certain portions including the ball guard broken away to reveal the interior structure.
Figure 4:
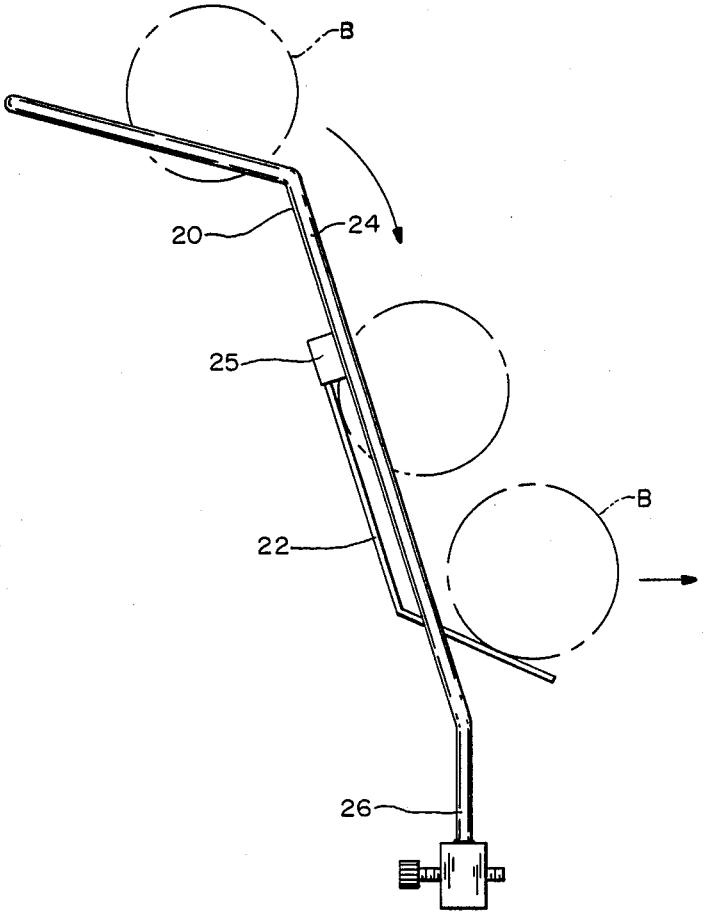
FIG. 4 is a side view of the ball feed mechanism utilized in the embodiment shown in FIG. 1.
Figure 5:
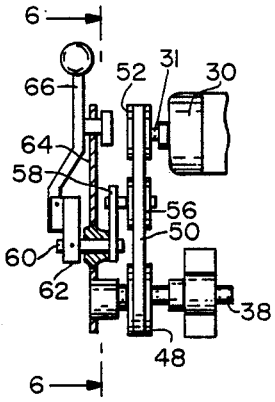
FIG. 5 is a fragmentary cross-sectional view taken along line 5—5 of FIG. 1.

Referring initially to FIGS. 1 and 2, the overall structure of the ball projecting apparatus will be described. The ball projecting apparatus 1 includes a throwing mechanism 3 pivotably mounted on a tripod base 5. A basket 7 is provided to collect balls to be thrown and optional wheels 9 allow the device to be easily transported.

Ball throwing mechanism 3 includes a pair of ball-contacting discs 10 and 12 that have angularly opposed, substantially planar ball engaging surfaces 11 and 13 as their adjacent interior surfaces. It should be understood that the machine shown in FIGS. 1 and 2 is arranged to pitch a ball in a trajectory that includes backspin. Each ball-contacting disc 10 and 12 has an associated positioning disc 15 and 17 that is mounted coaxially on the ball engaging surfaces 11 and 13 respectively. The ball contacting discs are mounted such that their spacing varies between a maximum distance greater than the diameter of the balls to be thrown and a minimum distance that is no greater than the balls' diameter the perimeter of the ball contacting discs are tapered to form an oblique angle with the associated positioning surface. The oblique orientation of the perimeter of the ball positioning discs provides a solid surface for the ball to rest against as it is carried through the throwing motion. Feed chute 20 which includes a leaf spring 22 directs balls into the space between ball contacting discs 10 and 12 at a point where they are sufficiently far apart to receive the ball.

To facilitate a throw, the ball is placed into feed chute 20 which consists of parallel rods 24 and 26. The feed chute 20 directs the ball downwardly into the space between the ball-contacting discs 10 and 12. Leaf spring 22 presses the ball against either the ball contacting discs or the positioning discs which engage and accelerate the ball for ultimate tangential delivery towards the batter as indicated in FIG. 1. Since the ball is introduced at a point where the ball contacting discs are relatively far apart, it brushes against the rapidly spinning discs and is thus accelerated. Positioning discs 15 and 17 limit the radial position at which the ball must be carried, and also provides an additional surface for contacting and thereby accelerating the ball. The ball-contacting and positioning discs are sized and mounted so that the ball will be forced to abut against both of the positioning discs and both of the ball-contacting discs as it presses through the narrowest portion of the discs orbit. Thus, the positioning discs 15 and 17 serve to precisely locate the balls on the ball contacting discs 10 and 12. By precisely controlling the radial position of the balls relative to the ball contacting discs 10 and 12 the release point of ball can be accurately repeated. Assuming the rotative speed of the discs and the size of the balls both remain the same, the pitches thrown from the machine will be extremely consistent.

A basket 7 positioned near the back of the ball throwing apparatus 1, permits convenient storage of balls and also acts as a counterweight to minimize the ball throwing apparatus' recoil when a ball is delivered. Optional wheels 9 allow the unit to be freely transported.

Each ball contacting disc 10 and 12 is independently energized by one of the two separate disc speed controllers that include variable speed motors 30 and 32 respectively. Since the two disc speed controllers are mirror images of each other, the system will be explained by reference to ball contacting disc 10. However, it is to be understood that the control system for ball contacting disc 12 may be identical.

Figure 6:
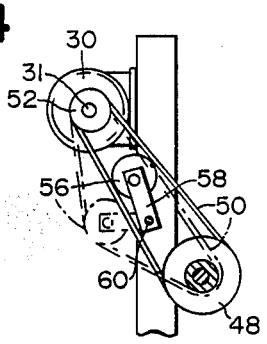
FIG. 6 is a sectional view taken along line 6—6 of FIG. 5.

Motor 30 is supported on a frame 44 which in turn is connected to tripod base 5 through various pivotal connections. Motor 30 having a motor drive shaft 31 is interconnected with disc drive shaft 38 by a variable speed pulley and belt arrangement. More particularly, the disc drive shaft 38 mounts at its extremity to variable diameter pulley 48 about which is trained a pulley belt 50 that is also trained about a standard pulley 52 disposed on the motor shaft 31. At an intermediate position between the motor and disc drive shafts, an idler pulley 56 is mounted for rotation at one end of a crank arm, 58. The opposite end of crank arm 58 is secured to one end of a rod 60 which extends through a bearing 62 in a side housing 64 for connection at its extremity to a speed adjustment handle 66. When speed adjustment handle 66 is moved from the substantially upright position shown in FIG. 1, in a counterclockwise direction, idler pulley 56 will be moved from the full-line towards the dotted-dash line disposition shown in FIG. 6 thereby automatically decreasing the diameter of the variable diameter pulley 48 on the disc drive shaft 38 to cause the same to rotate at a higher rotative speed. The side of housing 64 which mounts the speed control handle 66 is provided with detents 68 so that the speed can be adjusted to a number of intermediate positions between the two illustrated extremes. Since the idler pulley 56 is moved quickly from one of its adjusted positions to another when the handle is manually operated, the rotative speed of ball-contacting members then can be very quickly changed from one rotative speed to another allowing the operator to quickly provide a "change-up" pitch. The time for such adjustments is normally less than two seconds.

The machine shown in FIGS. 1 and 2 is arranged to project a ball B in a trajectory that simulates a baseball pitch. The ball is manually dropped into the upper end of feed chute 20 which consists essentially of a pair of parallel rods 24 that direct the ball downward into the space between the ball-contacting members 10 and 12. A leaf spring 22 is provided at a position within the chute at approximately the point where the ball enters the space between the ball-contacting discs 10 and 12. Leaf spring 22 extends beyond the plane made by the parallel rods and thus urges the ball to contact against positioning discs 15 and 17. Thus, the spring 22 insures that the ball abuts against the positioning disc when it is engaged by the ball-contacting discs 10 and 12, thereby accurately locating the ball on the ball-contacting discs and therefore its release point. By way of example, parallel rods 24 may be fashioned from a single rod that is U-shaped at its upper end. The rods may be bent so as to have a substantially horizontal upper portion and an inclined lower portion that leads into the space between the ball-contacting wheels. A spring mount 25 is attached to the rods in any conventional manner to provide a base for leaf spring 22. By way of example, the spring mount 25 may be welded to rods 24. A brace 26 disposed at the bottom of feed chute 20 allows the feed chute to be securely fastened to frame 44 using bolts or any other suitable fastening means.

To control the placement of the ball over the plate, the orientation of the delivery mechanism 3 can be adjusted in either the vertical or horizontal directions. To provide for a lower or higher pitch or an inside or outside pitch, means are provided for adjusting the entire propelling mechanism about a substantially horizontal (X axis) and also about a substantially vertical or (Y) axis as shown in FIGS. 1 and 2. The entire mounting frame 44 for the ball-contacting members 10 and 12 as well as their associated disc speed controllers are pivotably mounted to tripod base 5.

To provide for lateral adjustments of the substantially vertical or Y axis the mounting bracket 74 is rotated about pivot shaft 78, which projects upwardly from tripod base 5. Adjustments about the substantially horizontal X axis are accommodated by pivot pin 72 in conjunction with a threaded crank 76 that extends through a suitable threaded opening on bracket 74 to engage at its extremity mounting frame 44. Pivot pin 72 is disposed at the top of angularly upwardly extending bracket 74. Thus, as threaded crank 76 is rotated it will move mounting frame 44, causing rotation of the entire throwing mechanism 3 and ultimately causing a variation in the elevation of the balls trajectory.

Although only one embodiment of the present invention has been described herein, it should be understood that the present invention may be embodied in many other specific forms without departing from the spirit or scope of the invention. Particularly, it should be noted that the construction of the ball handling machine apart from the rotary projecting mechanism may be widely varied to accommodate both aesthetic concerns and specific requirements of a particular type of throwing machine whether it be used primarily for tennis, softball, baseball, or otherwise. Similarly, for such uses as batting practice or work on a tennis stroke, it may be desirable to automatically feed the balls into the throwing mechanism. It is contemplated that a wide variety of such automatic feeding devices may be used that are well known to the art. Additionally, it should be appreciated that the ball positioning discs may take a wide variety of forms, so long as their outer perimeter is substantially annular. Thus, in addition to taking the shape of solid discs, they may take such forms as annular rings or spoked wheels. Therefore, the present examples and embodiments are to be considered as illustrative and not restrictive, and the invention is not to be limited to the details given herein, but may be modified within the scope of the appended claims.

What is claimed is:

1. A ball throwing machine comprising:

a pair of rotary ball-contacting discs having angular opposed ball-contacting surfaces whose spacing varies between a maximum distance greater than the diameter of a ball to be thrown and a minimum distance no greater than the ball diameter;

rotary means for rotating said ball contacting members; and a pair of positioning discs for precisely controlling the tangential release position of the ball, each said positioning disc being associated with a particular one of said ball contacting discs, and arranged to contact the ball simultaneously with said ball contacting surfaces.

2. A ball throwing machine as recited in claim 1, further comprising a means for securely fastening said positioning disc to said rotary means and wherein each said positioning disc is disposed coaxially with its associated ball contacting surface.

3. A ball throwing machine as recited in claim 2, wherein said ball contacting discs take the form of annular discs.

4. A ball throwing machine as recited in claim 3 further comprising adjustment means for altering the position of the ball-contacting discs for adjusting the trajectory of the balls thrown.

5. A ball throwing machine as recited in claim 2, wherein said ball positioning discs have a tapered perimeter.

6. A ball throwing machine as recited in claim 2 wherein said rotary means include two independent motors, each said motor being associated with a particular one of said ball-contacting discs.

7. A ball throwing machine as recited in claim 6 further comprising a speed control means for selectively varying the rotational speed of the ball-contacting discs.

8. A ball throwing machine as recited in claim 1, further comprising a feed mechanism for providing balls to be presented to said ball-contacting discs, said feed mechanism including a biasing means for inducing the balls to contact said positioning discs at a radial position that is before the natural geometry of the rotary ball contacting discs would force such contact.

9. A ball throwing machine as recited in claim 8 wherein said biasing means includes a leaf spring.

10. In a ball throwing machine having a pair of opposed rotary ball-contacting discs having angularly aligned ball contacting surfaces adapted for propelling a substantially spherical ball, rotary means for rotating said ball contacting discs, a feeding mechanism for supplying the balls to said ball contacting discs, and an adjustment means for selectively adjusting the vertical and horizontal position of the ball contacting discs for roughly positioning the point at which the ball is released, the improvement comprising:

a pair of positioning discs for precisely controlling the tangential release position of the thrown ball, each said positioning disc being attached to a particular one of said ball contacting surfaces and arranged for contacting the ball simultaneously with said ball contacting surfaces prior to the ball's release.

11. A ball throwing machine as recited in claim 10 wherein said positioning discs are mounted coaxially with said ball-contacting discs and are disposed such that the ball to be thrown simultaneously contacts both ball-contacting discs and both positioning discs when the ball passes the radial position where the pair of angularly aligned ball contacting surfaces are at their closest.

12. A ball throwing machine as recited in claim 11 further comprising an attachment means for securing said positioning discs and said ball-contacting discs to said rotary means and wherein each one of said positioning discs have substantially circular cross-section.

13. A ball throwing machine as recited in claim 12, wherein said rotary means includes two independent motors, each said motor being associated with a particular one of said ball-contacting discs, and wherein said attachment means includes a pair of threaded posts which connect said rotary means to said positioning and ball-contacting discs through a threaded aperture that communicates with said positioning and ball-contacting discs.

14. A ball throwing machine as recited in claim 11, further comprising a feed mechanism for providing balls to be thrown to said ball-contacting discs, said feed mechanism including a biasing means for inducing the balls to contact said positioning discs at a radial position that is before the natural geometry of the rotary ball contacting discs would force such contact.

15. A ball throwing machine as recited in claim 14 wherein said biasing means includes a leaf spring.

16. A ball throwing machine comprising:

a pair of angularly opposed ball contacting discs adapted to propel a substantially spherical ball, each said ball contacting disc having an axis of rotation and including a contacting surface for engaging the ball and a positioning surface for precisely controlling the radial position at which the contacting surface engages the ball, the positioning surface engaging the ball at a radial position that is closer to the disc's axis of rotation than is the point at which the contacting surface engages the ball, wherein each said ball contacting disc engages the ball at only two points;

rotary means for rotating said ball contacting discs about their axis of rotation; and feeding means for feeding balls to said ball contacting discs.

17. In a ball throwing machine having a pair of opposed rotary ball-contacting discs having angularly aligned ball contacting surfaces adapted for propelling a substantially spherical ball, rotary means for rotating said ball contacting discs, a feeding mechanism for supplying the balls to said ball contacting discs, and an adjustment means for selectively adjusting the vertical and horizontal position of the ball contacting discs for roughly positioning the point at which the ball is released, the improvement comprising:

a pair of positioning discs for precisely controlling the tangential release position of the thrown ball, each said positioning disc being attached to a particular one of said ball contacting surfaces and contacting the ball prior to its release.

* * * * *